United States Patent [19]

Rusinko

[11] 4,152,040

[45] May 1, 1979

[54] CRT PIN ALIGNMENT MEANS AND METHOD OF UTILIZATION

[75] Inventor: William Rusinko, Cayuga, N.Y.

[73] Assignee: GTE Sylvania Incorporated, Stamford, Conn.

[21] Appl. No.: 857,597

[22] Filed: Dec. 5, 1977

[51] Int. Cl.[2] ..... H01J 5/48

[52] U.S. Cl. ..... 339/144 T; 313/318

[58] Field of Search ..... 339/144 T, 145 T; 313/318, 326, 331

[56] References Cited

U.S. PATENT DOCUMENTS

| | | | |
|---|---|---|---|
| 4,064,412 | 12/1977 | Johnson | 339/144 T X |
| 4,075,531 | 2/1978 | Marino | 313/318 X |

*Primary Examiner*—Roy Lake
*Assistant Examiner*—E. F. Desmond
*Attorney, Agent, or Firm*—William H. McNeill

[57] ABSTRACT

A removable pin-aligning insert is formed for positioning within a substantially tubular, pin isolating means of a cathode ray tube base. This insert assures positive alignment of the respective isolated tube connector pin within the tubular, pin isolating means from the time the base is applied to the tube until subsequent utilization.

1 Claim, 9 Drawing Figures

CRT PIN ALIGNMENT MEANS AND METHOD OF UTILIZATION

CROSS REFERENCE TO RELATED APPLICATIONS

Filed concurrently with this application and assigned to the assignee of the present invention, is a related application Ser. No. 857,596, which pertains to an improvement in CRT pin alignment means.

BACKGROUND OF THE INVENTION

This invention relates to means for assuring discrete pin alignment in a cathode ray tube-base assembly and more particularly to means for achieving alignment of at least one CRT pin spatially encompassed within a substantially tubular, pin isolating means of the associated base member.

The advance of cathode ray tube technology, in particular, the tube types employed in color television applications, has resulted in the development of more compact electron gun structures evidencing greater efficiencies. These smaller-in-size guns, being oriented within tube envelope neck portions of reduced diameter, have the necessary operating voltages for the various elements thereof (heaters, cathodes, accelerating and focusing electrodes, etc.) supplied via an annular array of connector pins sealed into and projecting from the stem closure portion of the tube. As the neck diameters of the tube envelopes become smaller, the spacings between the connector pins likewise decrease.

Certain currently produced tubes have large voltage differentials between certain of the pins in the connector array. This differential, sometimes in the order of 5 KV to 12 KV, has necessitated the incorporation of some form of arc protection into the tube base and socket combination. Bases and sockets have been designed in the art to minimize inter-pin arcing wherein at least one of the vulnerable high voltage pins is tubularly encompassed by a spatially related isolation structure integrally formed as part of the base member. In conjunction therewith, a compatible socket member has receiving means to mate with the respective tubularly encompassed pin, thereby effecting an isolated high voltage connection. While this type of connection has been found to be very beneficial, its advantages have been overshadowed by the fact that if the pin, positioned within the protective tubulation, becomes bent out of alignment, during tube basing or as a result of subsequent tube mishandling, here is no easy way of straightening the pin due to the narrow dimensioning of the surrounding tubulation. Consequently, before the tube can be used, the base must be removed, the pin straightened and another base applied. This becomes a tedious and time-consuming procedure, since the base is usually affixed to the tube by a tenacious adhesive composition. There is also a danger of tube implosion during the tube de-basing operation.

OBJECTS AND SUMMARY OF THE INVENTION

Accordingly, it is an object of the invention to reduce and obviate the aforementioned disadvantages that have been evidenced in the prior art.

It is another object of this invention to prevent bending of the tubulation-encompassed pin during the tube basing operation.

Yet another object of the invention is the positive protection of the tubulation-encompassed pin during the period between basing and ultimate usage.

Still another object of the invention is the provision of a tube product of improved quality by assuring positive alignment of the tubulation-encompassed pin at the time of tube utilization.

These and other objects and advantages are achieved in one aspect of the invention by the provision of a removable pin-aligning insert fashioned for positioning within a substantially tubular, pin isolating means of a cathode ray tube base to assure positive alignment of the tube connector pin spatially accommodated therein.

DESCRIPTION OF THE PREFERRED EMBODIMENTS

For a better understanding of the present invention, together with other and further objects, advantages, and capabilities thereof reference is made to the following specification and appended claims in connection with the aforedescribed drawings.

Figure 1:
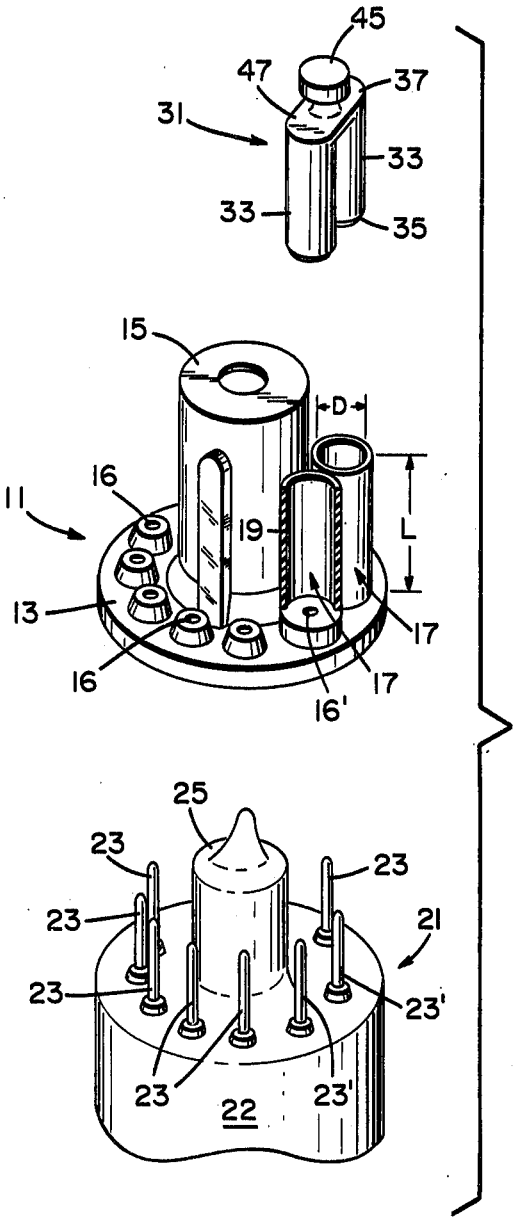
FIG. 1 is an exploded perspective view showing the manner in which the invention is associated with a discrete pin-isolating means of a CRT base and the respective tube pin or pins contained therein.

Referring now to the drawings, there is shown in FIG. 1 an exploded presentation wherein a specifically formed cathode ray tube base 11, having tubular, pin isolating means incorporated therein, is oriented to receive the conventional terminal array of connector pins 23, 23' protruding from the neck closure portion 21 of a CRT 22.

Associated with the base is specific pin alignment means 31 formed for insertion into the tubular, pin isolating means of the base to assure desired alignment of the tube pins 23' positioned therein.

Figure 3:
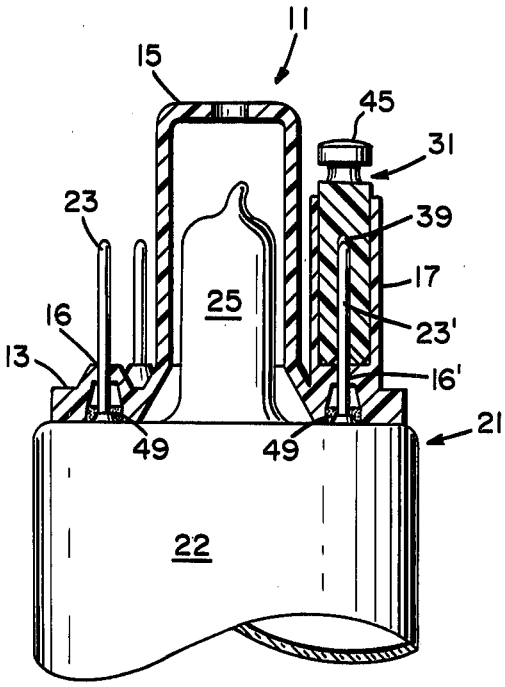
FIG. 3 is an elevational view, partially in section, illustrating the tube base mounted on the closure portion of a cathode ray tube with the pin aligning insert in position.
Figure 2:
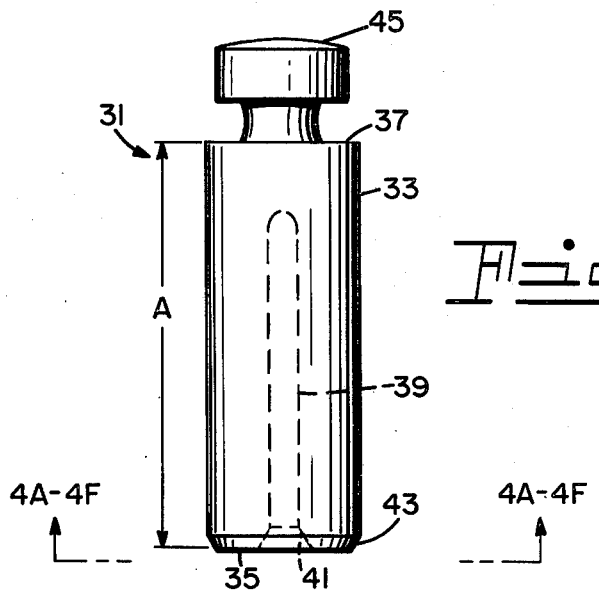
FIG. 2 is a sectional view of the pin aligning insert detailing the alignment feature therein.

In greater detail and with particular reference to FIGS. 1, 2, and 3, the base 11 for a cathode ray tube comprises a substantially planar circular portion 13, having therethrough a central aperture capped by a thimble-like crown 15 fashioned to receive and protect the sealed tubulation 25 of the tube 22. Surrounding the crown is an annular array of spaced-apart pin-receiving apertures 16. At least one of these apertures, 16', hs at least one tube pin isolating means 17 integrally associated therewith.

The removable pin-alignment means 31 of the invention has a basic longitudinal body member 33 formed of a suitable material such as polyethylene and fashioned for insertion into the open-ended tubular, pin isolating means 17 of the base. The body member has forward and rearward ends 35 and 37 defining a body length "A" therebetween that at least approximates the depth "L" of the tubular structure 17. The cross-sectional configuration of the insert body member, which in this instance is substantially round, is similar to the internal cross-section of the tubular, pin isolating means 17 and is dimensionally compatible therewith to facilitate a slide-fit engagement therebetween.

Formed within the insert body member 33 is a longitudinal bore 39 entered from the forward end 35 and oriented to be in coaxial alignment with the respective base aperture 16' located in the bottom of the tubular, pin isolating means 17. Bore 39 is of a depth at least equalling the length of the tube connector pin 23' to be subsequently positioned therein, and is dimensioned to substantially provide contiguous encompassment of the pin. Additionally, the bore is formed to have an infundibular pin-guiding entrance 41 to enhance entrance of the pin. The periphery of the forward end 35 of the body member 33 is usually beveled or rounded as at 43 to facilitate mating within the tubular, pin isolating means 17.

A handle protuberance 45 can be formed on the rearward end 37 of the insert body member 33 to facilitate placing and removing the pin aligning means 31 into and from the related tubular, pin isolating means 17. When two inserts are oriented in substantially adjacent relationship to mate with two tubular, pin isolating means, the two inserts may be integrated by a yoke 47 joining their rearward ends and having a common handle protuberance 45.

In utilizing the invention, the pin aligning insert means 31 is positioned within the tubular pin isolating means 17 of the base member 11, with the longitudinal pin-accommodating bore 39 in the body member 33 of the insert means being in coaxial alignment with the respective aperture 16'. The base member, with the insert therein, is then ready for engagement with the closure portion 21 of the cathode ray tube 22.

Before applying the base to the tube, it has been conventional practice to apply an electrically insulating adhesive 49 to the circular array of pins 23, 23' where they emerge from the closure portion 21 of the CRT 22. In addition to affixing the base to the tube, this adhesive also inhibits arcing across the closure surface between adjacent pins.

The base, with the insert means 31 therein, is mated with the stem closure portion 21 by inserting the array of pins through the appropriate base apertures and thence firmly seating the base 11 against the stem closure portion 21. Curing of the adhesive 49 insures bonding of the base to the stem. The integrated, assembled combination is shown in FIG. 3.

As described, the insert means 31 is desirably retained in the tubular, pin isolating means 17 until a subsequent time when an external socket is connected thereto. The configuration of the insert means results in a structure that does not deleteriously extend beyond the crown 15 of the base portion. Thus, it is substantially unobtrusive to tube packaging requirements. Removal of the insert just prior to socket attachment insures positive alignment of the tubulation encompassed pin or pins at the time of tube utilization. Should the tube be removed from operation and placed in storage, the pin alignment means is re-inserted to insure protection for the respective pin.

Figure 4A:
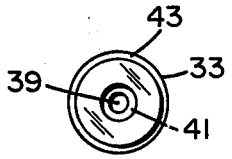
FIGS. 4A–4F represent a series of possible end configurations of the pin aligning insert taken along the line 4A–4F of FIG. 2.
Figure 4B:
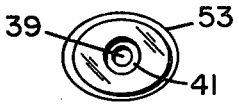
Figure 4C:
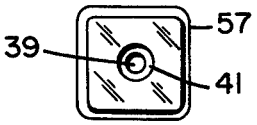
Figure 4D:
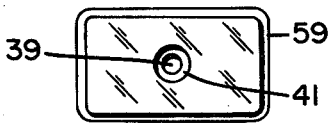
Figure 4E:
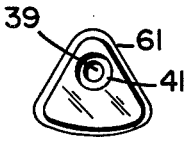
Figure 4F:
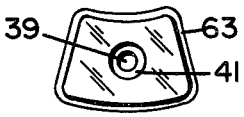

While the lateral configuration of the insert means 31, in this instance is substantially round as shown in FIGS. 1 and 4A, other lateral configurations are also in keeping with the intended scope of the invention. For example, other end-viewed configurations designed to be compatible with tubular pin-isolating means may include ovate, FIG. 4B; square, FIG. 4C; rectangular 4D, quasitriangular, 4E; and quasi-trapezoidal, 4F.

Thus, there is provided a positive means to prevent bending of the tubulation-encompassed pin during the tube basing operation.

In addition, the easily inserted and removed aligning means of the invention provides protection for the respective pin or pins during the period between tube basing and ultimate usage. The resultant is a tube product of improved quality.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method of utilizing a longitudinally formed CRT pin aligning insert, having a longitudinal pin accommodating bore therein, fashioned for use with a CRT base having a plurality of apertures mating with an array of pins protruding from the stem closure portion of a CRT, one of said pins being isolated by traversing an aperture which is surrounded by a tubular, pin isolating means formed as an integral part of the base, said method comprising: positioning said pin aligning insert within said tubular isolating structure with said pin accommodating bore being coaxially aligned with the respective base aperture; dispensing insulative adhesive on said stem closure around said array of pins; mating said base with said tube closure portion by inserting said pins through said base apertures and seating said base against said stem closure and the adhesive disposed thereon, said isolated pin being encompassed within the bore of said insert; curing said adhesive to affix said base to said tube; and retaining said insert in said tubular pin isolating structure until a subsequent time when said pin aligning insert is removed and external socket means attached thereto.

* * * * *